US005096228A

United States Patent [19]

Rinderknecht

[11] Patent Number: 5,096,228

[45] Date of Patent: Mar. 17, 1992

[54] NOTCHED I.D. CARD

[76] Inventor: Lester W. Rinderknecht, Star Rt. 1, Weed, N. Mex. 88354

[21] Appl. No.: 469,774

[22] Filed: Jan. 10, 1990

[51] Int. Cl.[5] ..... B42D 15/00

[52] U.S. Cl. ..... 283/75; 283/900; 283/904

[58] Field of Search ..... 283/75, 900, 904

[56] References Cited

U.S. PATENT DOCUMENTS

| | | | |
|---|---|---|---|
| 2,568,427 | 9/1951 | Wolowitz | 283/75 |
| 3,921,318 | 11/1975 | Calavetta | 283/75 |
| 3,958,690 | 5/1976 | Gee, Sr. | 283/75 |
| 4,271,352 | 6/1981 | Thomas | 283/75 |

OTHER PUBLICATIONS

Notched Identification Card from U.S. Department of Commerce.

*Primary Examiner*—Douglas D. Watts
*Assistant Examiner*—Hwei-Siu Payer
*Attorney, Agent, or Firm*—James F. Duffy

[57] ABSTRACT

What has been disclosed herein represents an improvement in the existing system whereby identification cards are carried about the person in a manner in which, under the prior art, access to individual identification cards was difficult. The improvement comprises a non-slip finger engaging notch which permits the ready withdrawal of individual cards from card carrying cases without slippage between the fingers and the surface of the card.

6 Claims, 1 Drawing Sheet

NOTCHED I.D. CARD

BACKGROUND

1. Field of the Invention

The invention relates to the field of identification cards of the type including those cards which are generally known as credit cards. The invention particularly relates to means for easily removing an I.D. card from the pocket of a carrying case in a manner which overcomes finger slippage on the surface of such cards.

2. Prior Art

Much of our society revolves about the ability to identify oneself. Small, pocket sized plastic cards daily determine our access to goods and services. We use our plastic library identification card to withdraw books. We use our college identification card to confirm our entitlement for services within the college. We use our warehouse buyer's identification card to purchase goods at discounted prices. In making consumer purchases, credit cards have virtually replaced checks and even cash.

It is not unusual for a person to carry eight to ten identification cards within the pockets of their wallets or specialized carrying cases intended for the transport of such identification cards. Within these cases' wallet pockets the identification card is almost fully encompassed. Only a small portion along one edge of the card remains exposed when the card is emplaced within one of these pockets. To maintain the wallet or card case a reasonable size for carrying within pocket or purse, the pockets are placed closely adjacent to each other. As a result, when several such identification cards are stored within these pockets, the cards become difficult to remove. There is a little surface area to grasp on the card and the tightly packed mass is difficult for the fingers to grasp. The problem is compounded by the slick plastic surfaces of these cards; and the fingers tend to slip from the card when trying to withdraw a card from a pocket.

It is the intention of the invention disclosed herein to eliminate the difficulty experienced in attempting to remove an identification card from the pocket or such a wallet or carrying case.

SUMMARY OF THE INVENTION

The invention may be characterized in at least three ways. The first characterization would be that of an improvement to an identification system. That system includes a wallet carrying case for carrying a plurality of identification cards individually in pockets within the carrying case. The confinement of identification cards within these pockets makes it difficult to remove the cards from the case. The improvement which is intended for ease of removal of the cards from the case comprises an identification card which has non-slip engaging means on it so that a person may engage the card, easily removing the card from the carrying case. The non-slip engaging means may comprise a finger notch in the card to be engaged by a person removing the card from the pocket.

A second characterization of the invention might be summarized as an identification system. This system comprises a card carrying case which has pockets for holding identification cards. There is an identification card carried within one of the pockets and the card has non-slip withdrawal means. The non-slip withdrawal means is physically exposed when the identification card is carried within the pocket. As with the earlier characterization, the non-slip withdrawal means may be readily engaged by a person seeking to remove the card from the pocket. Again, similar to the first characterization, the non-slip withdrawal means may comprise a finger notch in the card to be engaged by a person when removing the card from the pocket.

The third characterization of the invention considers the improved identification card itself. The improved card is a wallet-sized identification card and having non-slip engaging means which permit the card to be manipulated and grasped by a person without finger slippage on the card. Again, preferably, the non-slip engaging means comprises a finger notch in the card.

DESCRIPTION OF THE DRAWINGS

FIG. 5 is a partial sectional view of an identification card taken through the non-slip engaging or withdrawal means.

Figure 6:
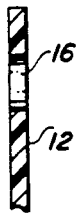

In the illustration of FIG. 6, the non-slip means is represented as a bore through the identification card.

Figure 7:
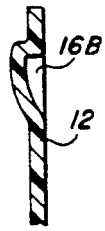

FIG. 7 is similar to the illustration of FIG. 6 except that the non-slip mans is represented as an indented impression in the surface of the identification card, rather than as a bore.

DETAILED DESCRIPTION OF THE INVENTION

For purposes of promoting an understanding of the principles of the invention, reference will now be made to the embodiments illustrated in the drawings and specific language will be used to describe same. It will nevertheless be understood that no limitation of the scope of the invention is thereby intended, there being contemplated such alterations and modifications of the illustrated device, and such further applications of the principles of the invention as disclosed herein, as would normally occur to one skilled in the art to which the invention pertains.

Figure 1:
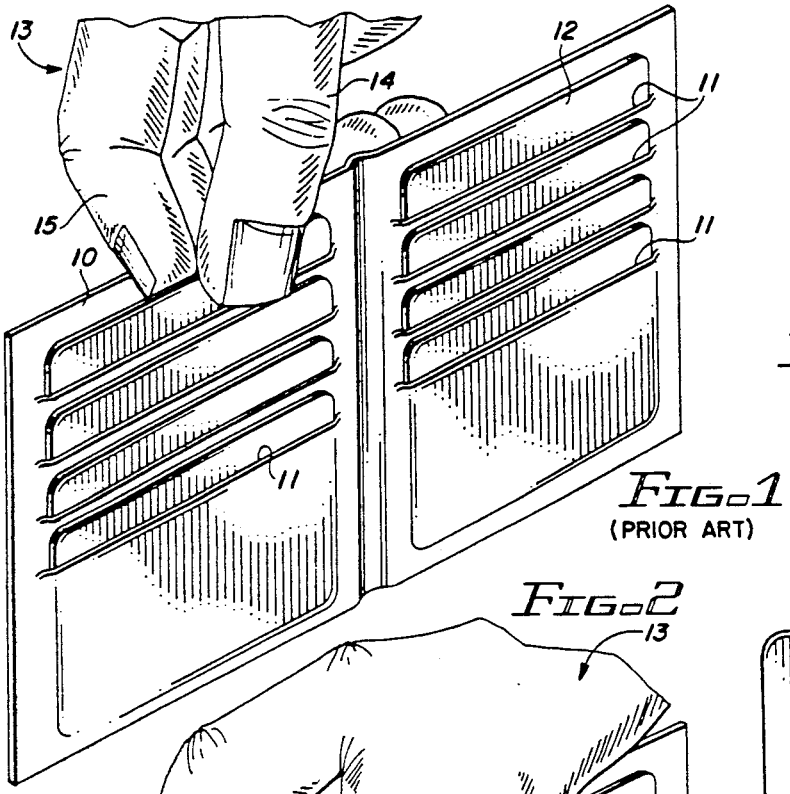
FIG. 1 (PRIOR ART)
FIG. 1 illustrates the prior art wherein identification cards are stored within a carrying case and the card edge must be grasped by the fingers of the hand to remove it from the carrying case.

FIG. 1 illustrates the practice of the prior art of storing a multiplicity of identification cards 12 within pockets 11 of a card carrying case 10. Case 10 is generally a wallet-sized case for carrying in a person's pocket or purse. Cases, such as case 10 illustrated, are designed to provide a person with convention means for carrying the multiplicity of credit cards and identification cards of other types which are used by a person frequently throughout the week. To maintain a package ;size which fits within a pocket or purse, the case 10 is designed to contain a multiplicity of cards in a minimal amount of space. In other words, the identification cards 12 are tightly packed when placed within the pockets 11 of case 10.

In attempting to remove a card 12, under prior art conditions illustrated in FIG. 1, a person places his hand 13 in the vicinity of the card to be removed from case 10. A person then attempts to inset finger 15 behind the exposed edge of card 12 so as to grasp the card between finger 15 and thumb 14. Conditions exist which tend to inhibit the easy removal of a card 12 from case 10 in this manner.

Because of the tight packing of cards 12 within case 10, it is often difficult to insert a finger behind the exposed edge of a card 12. Because of the tight packing of a multiplicity of cards 12 within case 10 (the cards 12 are tightly compressed within the confines of case 10 within the pockets 11) a relatively significant amount of force is required to withdraw a card 12 from pocket 11. Further, because most identification cards are plastic and have a smooth, slick surface, finger slippage is often experienced in attempting to overcome the force necessary to withdraw the card 12 from pocket 11.

It is often frustrating for a person standing in line at a checkout counter and attempting to remove a credit card 12 from case 10 to find his fingers 14 and 15 repeatedly slipping from the exposed edge of card 12 before successfully being able to remove a card 12 from pocket 11.

Figure 2:
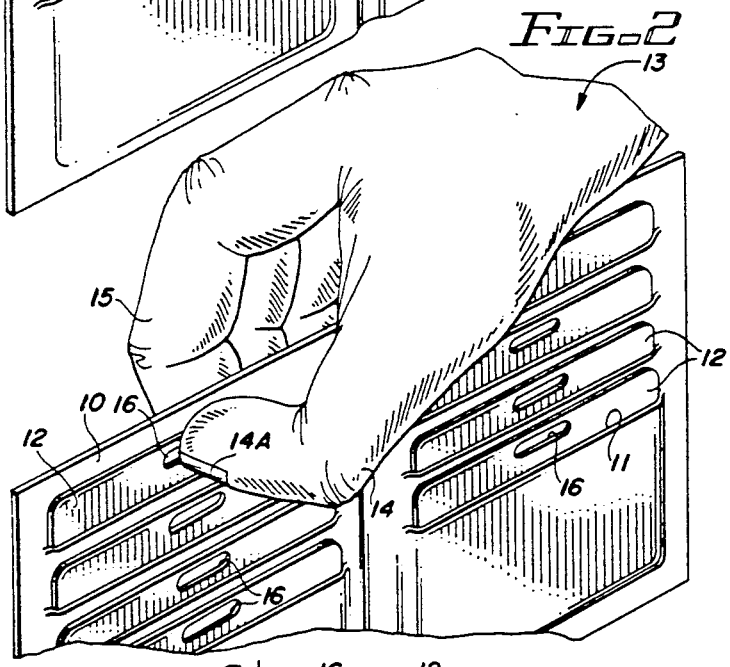
FIG. 2 is an illustration of the improvement of the invention wherein each identification card includes non-slip engaging or withdrawal means permitting the identification cards to be readily withdrawn from a pocket of the case without finger slippage on the surface of the card.

To overcome these difficulties, the invention provides a non-slip engaging means, alternatively referenced to as non-slip withdrawal means, whereby a person may apply pressure against the surface of card 12 in the direction intended to remove it from a pocket 11 and readily make the removal. Such an arrangement is illustrated in FIG. 2. Here the non-slip engaging or withdrawal mans is illustrated as an oblong finger notch 16. When a person applies the thumb 14 of hand 13 to finger notch 16, the flesh of the thumb is compressed downward into the notch. A sliding pressure exerted upward, in the illustration of FIG. 2, causes card 12 to slide upwardly and out of pocket 11. Alternatively, a person may insert the tip of fingernail 14A into finger notch 16 and apply an upwardly directed pressure thereby removing card 12 from pocket 11. Because there is no slippage encountered between thumb 14 and card 12, card 12 is readily caused to move slidingly out of the pocket 11.

The non-slip engaging or withdrawal means 16 may be any means which allows the finger to be applied to the surface of the card 12 so as to prevent slippage of the finger on the surface of the card when attempting to overcome the compaction force retaining the card within a pocket 11. Thus, a region of the surface of card 12 might be treated so as to increase the coefficient of friction of the card's surface. Such treatment might be mechanical, as, for example, surface etching, or by chemical process to abrade the surface of the card. Thus, the use of a finger engaging notch as illustrated in the drawings is to be considered an exemplary embodiment and is not presented as a limitation on the invention.

Figure 3:
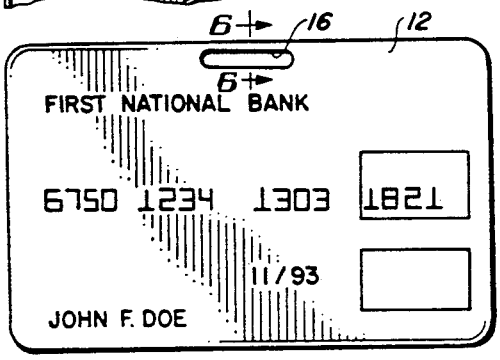
FIG. 3 illustrates the identification card as a credit card having a non-slip engaging or withdrawal means along a long side of said card.
Figure 4:
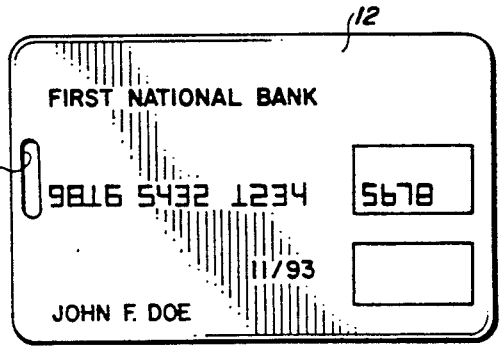
FIG. 4 is similar to the illustration of FIG. 3 except that the engaging or withdrawal means is emplaced alongside the short edge of the cared.

In FIG. 3, a credit card, identification card, is illustrated. Again, this is by way of example and no limitation is implied as to the type of identification card utilizing the invention. In FIG. 3, the engaging withdrawal means 16 is presented as a finger notch along the upper edge of the card 12. In the illustration, this is one of the long edges of card 12. With the non-slip engaging or withdrawal means 16 so positioned, the cards 12 present the appearance illustrated in FIG. 2, wherein case 10 has pockets designed such that a long edge of the identification card 12 remains exposed. Certain carrying cases, not illustrated, have pockets therein in which the narrow edge of the card 12 is exposed when emplaced in the pockets therein. To utilize the invention in this instance, the non-slip means 16 is emplaced within a short or narrow edge of the card, as illustrated in FIG. 4.

Figure 5:
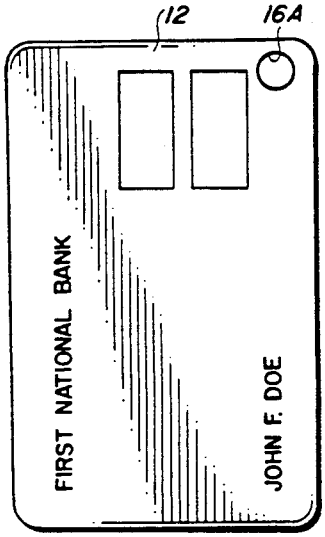
FIG. 5 illustrates non-slip engaging or withdrawal means having a different shape than those of FIGS. 3 and 4.

In FIG. 5, non-slip engaging means 16A is illustrated as a circular bore. This illustration is provided to emphasize the fact that the shape of the non-slip engaging or withdrawal means 16A is immaterial so long as it serves the purpose of eliminating slippage between the fingers attempting to remove the card and the surface of the card.

FIG. 6 is a side sectional view taken along the lines 6—6 of FIG. 3. In FIG. 6, the non-slip means 16 is illustrated as a through-bore in card 12. Again, this is by way of illustration and not of limitation.

FIG. 7 shows an alternate non-slip engaging or withdrawal means 16B which is an impression recessed within the surface of card 12, rather than a throughbore.

What has been disclosed herein represents an improvement in the existing system whereby identification cards are carried about the person in a manner in which, under the prior art, access to individual identification cards was difficult. The improvement comprises a non-slip finger engaging means which permits the ready withdrawal of individual cards from card carrying cases without slippage between the fingers and the surface of the card. For emphasis, it is again noted that the term "identification card," as used herein, is a generic descriptor which includes credit cards.

Those skilled in the art will conceive of other embodiments of the invention which may be drawn from the disclosure herein. To the extent that such other embodiments are so drawn, it is intended that they shall fall within the ambit of protection provided by the claims herein.

Having described the invention in the foregoing description and drawings in such a clear and concise manner that those skilled in the art may readily understand and practice the invention, that which is claimed is:

1. In a wallet carrying case in combination with a plurality of identification cards, said case having pockets for holding said cards, the improvement, for ease of removal of said cards from said case, comprising:

non-slip engaging means on each of said cards, whereby a person may engage said cards and easily remove said cards from said pockets in said carrying case.

2. The improvement of claim 1 wherein said non-slip engaging means comprises a finger notch in said card to be engaged by a person removing said card from a pocket in said case.

3. An identification system comprising:

a card carrying case having pockets;

an identification card carried within one of said pockets; and non-slip withdrawal means on said identification card physically exposed when said identification card is carried in said pocket, whereby said non-slip withdrawal means may be engaged by a person seeking to remove said cared from said pocket.

4. The system of claim 3 wherein said non-slip withdrawal means comprises a finger notch in said card to be engaged by a person removing said card from said pocket.

5. An improved identification card carrying combination comprising:

an identification card carrying case having a pocket for carrying a wallet-size identification card;

a wallet-sized identification card carried in said pocket; and a non-slip engaging means on said card;

whereby said card may be manipulated and grasped by a person without finger slippage on said cared as said card is removed from said pocket.

6. The identification card of claim 5 wherein said non-slip engaging means comprise a finger notch in said card.

* * * * *